United States Patent [19]

Kubo et al.

[11] Patent Number: 4,667,074

[45] Date of Patent: May 19, 1987

[54] TEMPERATURE DISPLAY FOR AN INDUCTION HEATING APPARATUS

[75] Inventors: Seiji Kubo; Mitsuo Yasuda; Akihide Katata, all of Shizuoka, Japan

[73] Assignee: Mitsubishi Denki Kabushiki Kaisha, Tokyo, Japan

[21] Appl. No.: 798,607

[22] Filed: Nov. 15, 1985

[30] Foreign Application Priority Data

Nov. 27, 1984 [JP] Japan ..... 59-179627[U]

[51] Int. Cl.[4] ..... H05B 6/06

[52] U.S. Cl. ..... 219/10.49 R; 219/10.77; 219/506; 219/512; 99/DIG. 14

[58] Field of Search ..... 219/10.49 R, 10.77, 219/10.75, 10.67, 506, 512, 464; 99/DIG. 14

[56] References Cited

U.S. PATENT DOCUMENTS

| | | | |
|---|---|---|---|
| 3,494,321 | 2/1970 | Moore et al. | 219/506 X |
| 3,624,352 | 11/1971 | Deaton et al. | 219/464 X |
| 3,906,424 | 9/1975 | Clancy et al. | 219/506 X |
| 4,169,222 | 9/1979 | Tucker | 219/10.49 R |
| 4,189,855 | 2/1980 | Robinson | 219/506 X |
| 4,242,304 | 12/1980 | Ryder | 219/506 X |
| 4,243,632 | 1/1981 | Ryder | 219/506 X |
| 4,334,135 | 6/1982 | Smith | 219/10.49 R |
| 4,388,520 | 6/1983 | McWilliams | 219/512 X |
| 4,577,176 | 3/1986 | Bayer | 219/512 X |

FOREIGN PATENT DOCUMENTS

| | | |
|---|---|---|
| 0078755 | 11/1983 | European Pat. Off. . |
| 2528181 | 1/1977 | Fed. Rep. of Germany . |
| 2638040 | 9/1978 | Fed. Rep. of Germany . |
| 2808181 | 6/1979 | Fed. Rep. of Germany . |
| 2901801 | 7/1980 | Fed. Rep. of Germany . |
| 2260249 | 8/1975 | France . |
| 2407433 | 5/1979 | France . |
| 59-37083 | 3/1984 | Japan . |

*Primary Examiner*—Philip H. Leung
*Attorney, Agent, or Firm*—Oblon, Fisher, Spivak, McClelland & Maier

[57] ABSTRACT

An induction heating apparatus is formed by connecting a plate or a rod made of good heat-transferring metal to the lower surface of an insulating plate, connecting a spring or a bimetal having shape-memorizing function to one end of the metallic plate or rod and providing a temperature displaying means at a corner portion or an operating part in the front surface of the insulating plate. The induction heating apparatus always displays a correct temperature in an insulating plate even at a high temperature in a cooking pot. Further, there is causing no shaving or peeling-off as seen in a paint in which change in color takes place depending on temperature and a danger of burn can be prevented.

9 Claims, 3 Drawing Figures

TEMPERATURE DISPLAY FOR AN INDUCTION HEATING APPARATUS

BACKGROUND OF THE INVENTION

1. Field of the Invention

The present invention relates to an induction heating apparatus capable of displaying temperature on an insulating plate thereby eliminating danger of a burn.

2. Related Art

FIG. 3 is a cross-sectional view of an induction heating apparatus for displaying temperature on an insulating plate as shown in, for instance, Japanese Examined Utility Model Publication No. 37083/1984. In FIG. 3, an induction coil table 2 is placed inside an outer casing 1 and an induction coil 3 is arranged on the induction table 2. An insulating plate 5 is attached to the outer casing 1 above the induction coil 3.

The insulating plate 5 is adapted to receive a cooking pot 4 on the upper surface on which a pattern diagram 6 is drawn so that the cooking pot 4 is put on the diagram 6. A paint of a color which is changeable depending on temperature is coated on the upper surface of the insulating plate 5 or the pattern diagram 6.

In the induction heating apparatus constructed as abovementioned, when the cooking pot 4 is on the insulating plate 5 for cooking, or the cooking pot 4 is removed from the insulating plate 5 after completion of the cooking, the insulating plate 5 is at a high temperature by heat transfer from the cooking pot 4.

Since the upper surface 5*a* of or the pattern diagram 6 on the insulating plate 5 is coated with the paint of a color which is changeable depending on temperature, the color is kept unchanged until the temperature of the insulating plate 5 becomes a predetermined value or less, whereby a user is aware of it and a burns caused by carelessly touching the insulating plate is prevented.

In the conventional induction heating apparatus, there are disadvantages as follows. The paint coated on the upper surface 5*a* of the insulating plate or the pattern diagram 6 may be peeled off when friction occurs between the upper surface 5*a* or the pattern diagram 6 and the cooking pot 4 or when the insulating plate 5 is polished by a polishing powder. Temperature indicating function is decreased due to deterioration in color-changing properties of the paint when the insulating plate is heated to a high temperature.

SUMMARY OF THE INVENTION

It is an object of the present invention to provide an induction heating apparatus capable of indicating correct temperature even when a temperature in the cooking pot is high, free from the trouble of peeling off of paint, providing information of temperature in the insulating plate to a user and minimizing danger of burns.

The foregoing and the other objects of the present invention have been attained by providing an induciton heating apparatus including an outer casing, an insulating plate attached to the upper part of the outer casing, an induction coil disposed below the insulating plate, a metallic body having good heat transfer properties, one end of which is extended near the induction coil and is heated by the coil and which senses temperature in the insulating plate, a temperature displaying means, and a shape-memorizing means which is connected between the other end of the metallic body having good heat transfer properties and the temperature displaying means so as to be expansible and contractible by heat from the metallic body to thereby display a temperature in the temperature display means.

In the present invention, a temperature in the insulating plate can be displayed at any position other than a central portion of the insulating plate, even for a short time cooking in which only the central portion of the insulating plate is heated.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
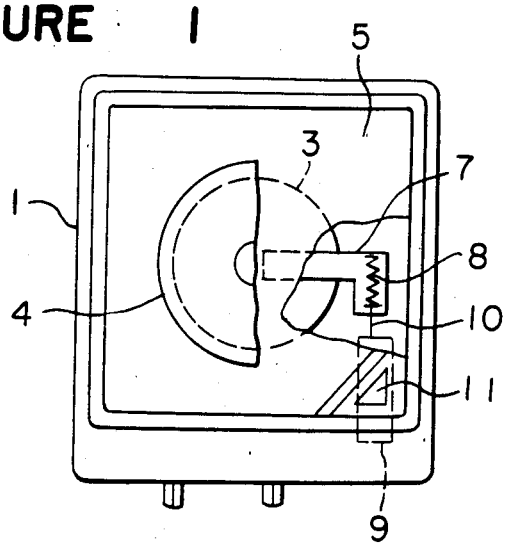
FIG. 1 is a top veiw of an embodiment of the induction heating apparatus according to the present invention.

Preferred embodiments of the present invention will be described with reference to the drawing.

Figure 3:
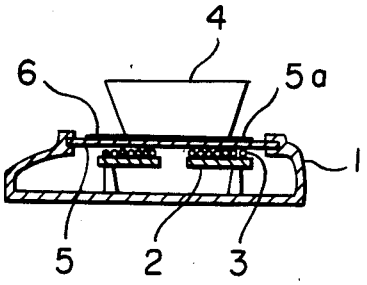
FIGURE 3 PRIOR ART
FIG. 3 is a cross-sectional view of a conventional induction heating apparatus.

In FIG. 1 showing the top of the induction heating apparatus of the present invention, a pattern diagram 6 and an induction coil table 2 as shown in FIG. 3 are omitted for the purpose of simplification.

An L-shaped metallic plate 7 having good heat transfer properties is provided below the insulating plate 5 with its longer side extended to the central portion of the insulating plate 5 and a shorter side extended in the vicinity of a side edge of the insulating plate 5. A rod member having good heat transfer properties may be used instead of the metallic plate. It is preferable that the metallic plate 7 is firmly attached to the reverse surface of the insulating plate 5 with the end of the longer side on the induction coil 3. A spring 8 is attached to the shorter side of the L-shaped metallic plate 7. The spring 8 is made of a material having a shape-memorizing function.

The spring 8 is connected to a display plate 9 for displaying a temperature in the insulating plate 5 through a connecting rod 10. The display plate 9 is to display whether a temperature in the insulating plate 5 is hot or cold. A display window 11 is formed in the insulating plate 5 at a position above the display plate 9. The display window 11 is arranged at a corner portion of the insulating plate 5 and above the display plate 9.

The operation of the induction heating apparatus having the construction as abovementioned will be described.

When a current is supplied to the coil 3, an eddy current flows in the bottom of the cooking pot (not shown) due to electromagnetic induction effect to produce heat. The heat of the cooking pot is transferred to the insulating plate 5. When a "Tempura" or a "steak" is cooked, a temperature in the insulating plate 5 reaches about 300° C. In this case, one can be accidentally burned by touching the insulating plate since a user can not know condition of the insulating plate from the appearance of the plate. In the present invention, however, the metallic plate 7 having good heat transfer properties is extended near the middle portion of the induction coil 3. Accordingly, the metallic plate 7 senses a temperature in the insulating plate 5 which corresponds to that in the middle portion of the induction coil 3 which is at the highest temperature.

Further, heat is produced by induction heating effect of the metallic plate 7 itself, the heat quickly being transferred to the spring 8 having a shape-memorizing function to cause expansion of the spring, whereby the display plate 9 is moved by means of the connecting rod 10.

Accordingly, a signal indicative of the insulating plate 5 being in hot condition is found in the display window 11, namely, it shows danger of a burn by touching it.

When a power source is shut off after completion of cooking, heat in the insulating plate 5 is radiated so that a temperature of the insulating plate gradually reduces. Then, there takes place contraction of the spring 8 since the spring is cooled through the metallic plate 7. The movement of the spring 8 is transmitted to the display plate 9 through the connecting rod 10. When a temperature in the insulating plate 5 reaches a value which does not cause a burn by touching of the insulating plate 5, a signal indicative of the acceptability of touching the insulating plate 5 is displayed in the display window 11. A display means constructed according to the present invention does not require a power source. Accordingly, a temperature in the insulating plate 5 can be continuously displayed even though a power source is shut off immediately after cooking has been finished.

Figure 2:
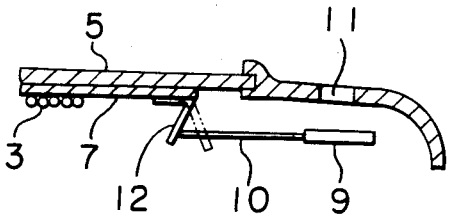
FIG. 2 is a cross-sectional view of an important part of another embodiment of the induction heating apparatus of the present invention.

Although the spring 8 having shape-memorizing function is used in the abovementioned embodiment, it may be possible to use a bimetal 12 as shown in FIG. 2.

Further, in the embodiment shown in FIG. 1, the display plate 9 is provided in the front part on the right hand of the insulating plate 5. However, the display plate 9 may be provided at a corner portion. In addition, a plurality of display plates 9 may be provided. Further, the display means may be provided at an operating part.

Thus, the induction heating apparatus of the present invention is constructed in such a manner that a metallic body having good heat transfer properties attached with a spring which has shape-memorizing function or a bimetal is provided on the reverse surface of the insulating plate, and a temperature displaying means is provided at a predetermined part in the insulating plate or in an operating part. Accordingly, an unexpected accident of a burn can be prevented by displaying a signal indicative of temperature in the insulating plate irrespective of a turning on or off of a power source.

We claim:

1. An induction heating apparatus which comprises:
an outer casing,
an insulating plate attached to the upper part of said outer casing,
an induction coil disposed below said insulating plate,
a metallic body having good heat transfer properties, one end of which is extended directly between said insulating plate and said induction coil, and which senses a localized temperature in said insulating plate,
temperature displaying means, and
shape-memorizing means connected between the other end of said metallic body having good heat transfer properties and said temperature displaying means so as to be expansible and contractible by heat from said metallic body to thereby display a temperature in said temperature displaying means.

2. An induction heating apparatus according to claim 1, wherein said temperature displaying means comprises a display plate having means indicative of high temperature and placed below said insulating plate, and a display window formed in said insulating plate at a position corresponding to said display plate.

3. An induction heating apparatus according to claim 1, wherein said one end of the metallic body is extended near the middle portion of said induction coil.

4. An induction heating appartus according to claim 1, wherein said one end of said metallic body contacts an underside of said insulating plate.

5. An induction heating apparatus according to claim 1, wherein said temperature displaying means is provided in a circumference of said insulating plate spaced from a central portion thereof on which an object to be heated is put.

6. An induction heating apparatus according to claim 1, wherein said metallic body is a metallic plate.

7. An induction heating apparatus according to claim 1, wherein said metallic body is a metallic rod.

8. An induction heating apparatus according to claim 1, wherein said shape-memorizing means is a spring.

9. An induction heating apparatus according to claim 1, wherein said shape-memorizing means is a bimetal.

* * * * *